United States Patent [19]

Booij

[11] Patent Number: 4,620,881

[45] Date of Patent: Nov. 4, 1986

[54] METHOD FOR CLEANING A STEAM GENERATOR

[75] Inventor: Johannes Booij, Rhoon, Netherlands

[73] Assignee: Innus Industrial Nuclear Services S.A., Geneva, Switzerland

[21] Appl. No.: 609,802

[22] Filed: May 14, 1984

[30] Foreign Application Priority Data

Aug. 26, 1983 [BE] Belgium ..... 2/60192(897603)
Apr. 5, 1984 [BE] Belgium ..... 2/60384

[51] Int. Cl.[4] ..... B08B 5/04

[52] U.S. Cl. ..... 134/21; 134/22.18; 134/24; 122/382; 122/392

[58] Field of Search ..... 134/21, 22, 18, 24, 134/167 R, 169 R; 252/600; 122/382, 381, 390, 391, 392; 15/316 A, 316 R

[56] References Cited

U.S. PATENT DOCUMENTS

| | | | |
|---|---|---|---|
| 3,254,448 | 6/1966 | Ruthner | 47/1.2 |
| 3,985,572 | 10/1976 | Petermann et al. | 134/167 R |
| 4,018,213 | 4/1977 | Mann, Jr. | 47/17 |
| 4,068,405 | 1/1978 | Campbell et al. | 47/65 |
| 4,079,701 | 3/1978 | Hickman et al. | 122/382 |
| 4,141,498 | 2/1979 | Marschner | 47/17 |
| 4,173,212 | 11/1979 | Whitcomb | 126/430 |
| 4,195,441 | 4/1980 | Baldwin | 47/17 |
| 4,198,953 | 4/1980 | Power | 126/428 |
| 4,249,340 | 2/1981 | Maes, Jr. | 47/1.7 |
| 4,255,897 | 3/1981 | Ruthner | 47/65 |
| 4,262,656 | 4/1981 | Esposito | 126/430 |
| 4,276,856 | 7/1981 | Dent et al. | 122/405 |
| 4,289,116 | 9/1981 | Williams | 126/431 |
| 4,356,664 | 11/1982 | Ruthner | 47/65 |
| 4,393,859 | 7/1983 | Marassy et al. | 126/429 |
| 4,407,236 | 10/1983 | Schukei et al. | 122/390 |
| 4,424,769 | 1/1984 | Charamathieu et al. | 122/391 |
| 4,452,183 | 6/1984 | Yazidjian | 122/390 |

FOREIGN PATENT DOCUMENTS

| | | |
|---|---|---|
| 890490 | 1/1982 | Belgium . |
| 2510234 | 1/1983 | France . |

*Primary Examiner*—Richard V. Fisher
*Assistant Examiner*—Sharon T. Cohen
*Attorney, Agent, or Firm*—Burns, Doane, Swecker & Mathis

[57] ABSTRACT

Through two accesses lying substantially opposite one another, above the bottom of the steam generator, a high-pressure lance carrying at its end a spray head, is brought between the pipes of the pipe bundle. The two lances are simultaneously intermittently shifted inwards or outwards and between the shiftings, when the spray heads may spray between the rows of the pipe bundle, the lances are swung to-and-fro over 180°. At least during said swinging, liquid is sprayed through said heads under a pressure higher than 200 bars and with a total flow rate for the two spray heads of more than 200 liters per minute. The used liquid is sucked away from the bottom with a total sucking capacity which is markedly higher than said flow rate.

17 Claims, 7 Drawing Figures

METHOD FOR CLEANING A STEAM GENERATOR

BACKGROUND OF THE INVENTION

This invention relates to a method for cleaning a steam generator of so-called U-type, which steam generator consequently comprises an upstanding outer casing, a pipe bundle mounted therein, which extends in the shape of a reversed U, and a bottom which closes at the foot of the pipe bundle the openings between the bundle pipes and between said pipes and the outer casing, which steam generator is provided with at least two accesses, lying above the bottom and substantially opposite one another, to the inner side, through which said pipe bundle may be reached, method according to which through at least two accesses lying substantially opposite one another, a high-pressure lance which is movable along the lengthwise axis thereof, is rotatable about the axis thereof and bears at the end thereof a spray head unmovably mounted thereon with spray openings directed cross-wise to the lance axis, is brought between the pipes of said pipe bundle, and through at least one access, at least one suction line is brought down about next to the bottom adjacent the outer casing, the spray heads are simultaneously intermittently shifted between about the generator center and about next to the outer casing, in such a way that between said shiftings, the spray heads may spray between rows of the pipe bundle, the spray heads are rotated about the lance axis at least between said shiftings, liquid under a pressure higher than 200 bars is sprayed through said spray heads at least during such rotation, and the used cleaning liquid is sucked away from the bottom through the suction line during the cleaning.

Steam generators of the above-defined kind are used in nuclear power stations. The heating fluid which is heated inside the nuclear reactor is lead through the pipe bundle and abandons heat to the fluid, generally water, which lies in the space about the pipes, whereby steam is generated. Said steam is used for driving turbines and after cooling, is returned back to said space.

Due to various chemical reactions, there is formed about the pipe bundle, an iron oxide, namely magnetite. Said iron oxide settles on the pipe bundle, the bearing plates for said pipe bundle, and mostly the bottom. At each maintenance procedure, generally yearly, of the nuclear power station, the iron oxide has to be removed. In connection with the difficult reachability of the steam generator and mostly due to the prevailing radioactivity, the steam generator cannot be dismantled for such cleaning, so that the removal of the sludge and thus more particularly the iron oxide, requires special methods. There is always made use therefore of accesses which are provided in the lower portion of the steam generator, above the bottom and which during the normal operation of said steam generator, open on lines or are closed by metering apparatus or covers. Through releasing one or a plurality of said accesses, it is possible to spray loose with a high-pressure lance having a spray head, the sludge from the bottom and possibly from other portions of the inner volume of the steam generator. The main problem does however lie in removing said sludge from the generator.

In known methods for cleaning a steam generator of the above-defined type, with the purpose of such removing, an additional amount of liquid is fed to the bottom during the spraying of pressurized liquid through the spray heads.

In the known method of the kind defined in this Application, which is disclosed in Belgian Pat. No. 889,706 (French Pat. No. 2,510,232 is equivalent), said additional liquid amount is fed by means of a sprinkling head which is brought above the bottom center.

When the steam generator is provided between the bottom and the lowermost pipe supporting plate, with four accesses, spraying is made under a pressure of about 250 bars by means of four high-pressure lances with spray head, which are brought-in through said four accesses. Said high-pressure lances are moved simultaneously stepwise from the center to the outer casing, and the lances are always rotated in the same direction over a plurality of revolutions about the axis thereof between the succeeding displacements.

The four spray heads have an outer diameter of but 8 mm and cannot spray enough liquid to insure good removal of the sludge from the bottom. Consequently there is caused during the spraying, a flowing over the bottom, from the center to the outer casing, by means of the sprinkling head which sprinkles low-pressure liquid on the bottom. The cleaning liquid and the sludge are sucked in two mutually opposite locations lying next to the outer casing.

When the steam generator also has two accesses opening above the lowermost supporting plate and lying opposite one another, there is first cleaned above the lowermost supporting plate with a high-pressure lance. Use is made therefore of but one high-pressure lance with spray head which is brought-in succeedingly through both accesses, each time being moved stepwise from the center to the outer casing, and being rotated always in the same direction over a plurality of revolutions about the lance axis between the steps. In spite of said spray head having a larger diameter than the above-mentioned heads, it cannot spray enough liquid on the supporting plate to insure good removal of the sludge therefrom , so that also during the cleaning of the supporting plate and those portions of the steam generator lying thereabove, additional liquid is sprinkled with the sprinkling head on the supporting plate.

To remove all the sludge from the bottom, it is necessary with this known method to spray moreover at the end of the cleaning, with spray guns, liquid under a pressure of 300 bars on the bottom, at least against the outer casing.

The use of a sprinkling head during the cleaning and of spray guns at the end, makes the method intricate and time-consuming. Said additional liquid feeding devices naturally also increase the volume and costs of the apparatus required for the application of the method.

Moreover it has been noted that in spite of sprinkling with the sprinkling head, sludge could still remain on the bottom. In certain locations on the bottom, a driving-back of liquid and consequently a limited liquid flow did in fact occur, because the liquid sprayed by the spray head or heads did oppose the flow of that liquid being sprinkled by the sprinkling head.

The invention has for object to obviate said drawbacks and to provide a method for cleaning a steam generator of the above-defined type which allows a useful removing of the sludge from the bottom in a simple and fast way, that is without an additional supply of liquid to cause a flowing over the bottom and possibly a spraying with spray guns at the end being necessary.

THE INVENTION

For this purpose, the high-pressure lances with spray heads are, at least between the shiftings along the lengthwise axis thereof, swung to-and-fro about said axis, a mean total flow rate of more than 200 liters per minute is sprayed by means of the spray heads, and liquid is sucked away from the bottom with a total sucking capacity which is markedly higher than said latter flow rate.

It is mostly the combination of the above mentioned high spraying pressure, the above mentioned simultaneous spraying with at least two high-pressure lances with spray head, and the conditions of revolving and flow rates mentioned herebefore, which allows to completely remove the sludge from the whole bottom without using an additional liquid feed or additional operations.

FURTHER BACKGROUND

The use of an oscillating high-pressure lance with spray head when cleaning a steam generator of the above-defined type, is known per se from U.S. Pat. No. 4,079,701, but with the method as disclosed in said Patent specification, the cleaning is performed with but one single high-pressure lance with spray head, which is brought into the steam generator succeedingly through two opposite accesses, and which is moved stepwise from next to the outer casing to the center. Said known method is thus not of the type as defined in this Patent Application, whereby there is sprayed at the same time with at least two spray heads. Besides, the single spray head in this known method has a flow rate of but about 110 liters per minute. The spraying pressure is not given. In any case also with this known method an additional feed of liquid causing a stream and actually a circumferential stream over the bottom, appears to be necessary to obtain a good removal of sludge from the bottom. Even with such additional liquid feed, the removing of sludge from the bottom is still quite difficult, probably because the flow caused by said additional liquid does not cover the complete bottom area. The single spray head does not only have to be brought-in succeedingly through two accesses, but also has to be moved to-and-fro several times along the lengthwise direction, in such a way that said method is quite time-consuming.

THE INVENTION

In a particular embodiment of the invention, the high-pressure lances bearing a spraying head at the end thereof, are swung to-and-fro over an angle which is smaller than 360° and preferably between two end positions which make an angle of about 180° to one another.

In a remarkable embodiment of the invention, the high-pressure lances bearing a spray head at the end thereof are only revolved between the shiftings thereof.

In an advantageous embodiment of the invention, a total flow rate which is larger than 250 liter per minute is sprayed.

In a useful embodiment of the invention, use is made for sucking the liquid from the bottom, of a pump with a suction capacity of at least 1000 liter per minute.

In a preferred embodiment of the invention, use is made for sucking the liquid from the bottom, of a line which comprises a flexible suction hose, and a metal shoe provided with a suction opening, which shoe connects through a connection opening to the end of the hose, which shoe is located on the bottom with the suction opening thereof directed along the bottom circumference.

In another remarkable embodiment of the invention, use is made for spraying of a spray head which comprises a hollow round body and which is provided with at least one pair spray openings directed cross-wise to the lengthwise axis and lying opposite one another.

Other details and advantages of the invention will stand out from the following description of a method for cleaning a steam generator, according to the invention; this description is only given as example and does not limit the invention; the reference numerals pertain to the accompanying drawings.

DRAWINGS

In the various figures, the same reference numerals pertain to the same elements.

DETAILED DESCRIPTION OF PREFERRED EMBODIMENTS

Figure 1:
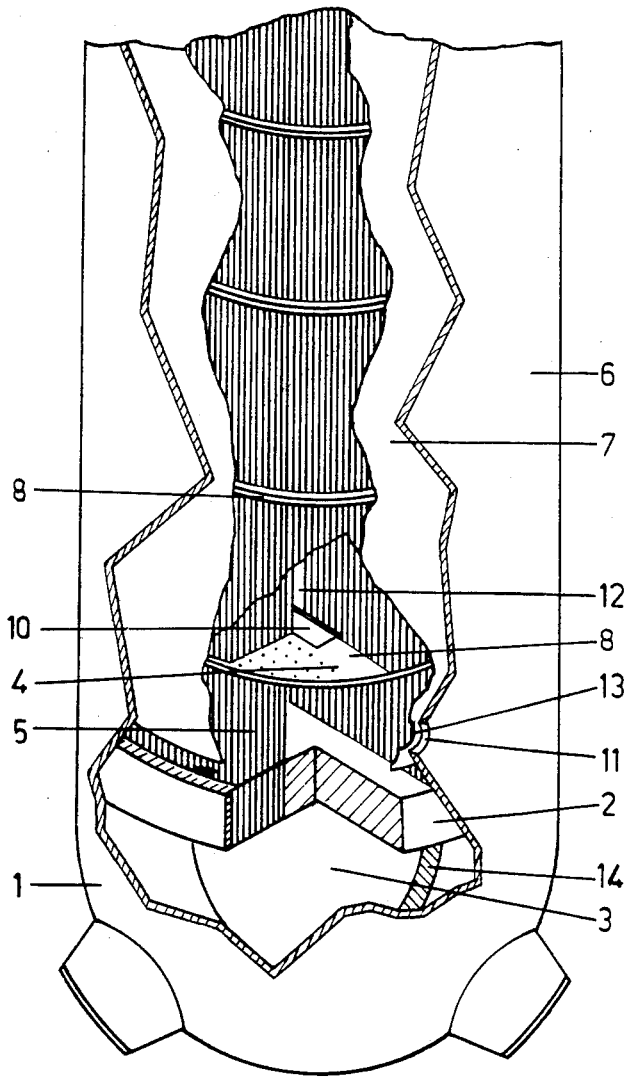
FIG. 1 is a front view with part cutting-away of a portion of a steam generator whereon the method according to the invention is applied.

The steam generator to which the method is applied and a portion of which is shown in detail in FIG. 1, is of the U-pipe type which is particularly used in nuclear power stations. Such steam generators are known per se and an embodiment thereof is notably described in the above-mentioned U.S. Pat. No. 4,079,701 included herewith by way of reference. The steam generator will then only be described hereinafter as far as required to make the method for cleaning clear.

As it appears mostly from FIG. 1, the steam generator thus comprises in a known way, a vertically-arranged round vessel 1 which is divided by a bottom 2 into two spaces, namely a lowermost space 3 for the primary medium heated by the nuclear reactor, and an uppermost space 4 for the secundary medium, which is the water to be converted into steam.

Inside the space 4 which opens with the upper side thereof on turbines not shown in the figures, a pipe bundle 5 is arranged, which bundle extends in the shape of a reversed U. As well the pipes of the upwards-running portion of the bundle as the pipes of the downwards-running portion thereof pass with the end thereof through the bottom 2 and thus communicate respectively with an outlet portion and an inlet portion of the space 3, which space is divided by a partition 14 in said two portions. Through the pipes of pipe bundle 5 thus flows the primary medium. The medium abandons heat to the water which is fed at the top to space 4, between the outer casing 6 which bounds the space 4 on the outer side and which is thus formed by the outer wall of vessel 1, and an inner casing 7 which surrounds the pipe bundle 5 and reaches down to a distance from bottom 2. The bottom 2 sealingly closes the openings between the pipes of pipe bundle 5, and between the pipes and the outer casing 6, so that said water cannot enter space 3. Said water rises inside the inner casing 7 and is converted into steam by contacting the pipe bundle 5, and is discharged at the top of space 4 through the steam turbines.

To retain the pipes of pipe bundle 5 in position, a plurality of supporting plates 8 lying above one another are arranged above bottom 2 and inside inner casing 7. The outer circumference of said supporting plate 8 lies some small distance away from the inner side of inner casing 7, so that a ring-like slit 9 remains open between the edge of each supporting plate 8 and the inner casing 7. Each supporting plate 8 is moreover further provided in the center thereof, between the ascending and descending portions of pipe bundle 5, with an opening 10.

During the operation of the steam generator, the sludge, mainly magnetite, settles down on the lower part of the steam generator, in such a way that the sludge to be removed lies mainly on bottom 2, the lowermost supporting plate 8, and the lowermost portion of pipe bundle 5.

The steam generator is provided above bottom 2 and adjacent thereto, with a plurality of accesses to said pipe bundle 5. Said accesses are either closed by covers, or communicate through a line with apparatus such as for example meters, during the normal use of the steam generator. The cleaning of the steam generator differs somewhat according to the number and location of said accesses.

In one embodiment of the above-defined known steam generator, said generator is provided between bottom 2 and the lowermost supporting plate 8, with two diametrically-opposed openings 11 with a diameter of about 15 cm, in the outer casing 6.

Said openings open on the space 12 between the ascending portion and the descending portion of the U-shaped pipe bundle 5. Opposite each opening 11 the inner casing 7, which reaches in this embodiment quite close to the bottom 2 and down to below the openings 11, is provided with an equally-sized opening 13 which forms together with said opening 11, an access to the pipe bundle 5. FIGS. 1 to 5 relate to this embodiment of the steam generator. For clearness' sake, the pipe bundle 5 is not shown in FIG. 2, and but partly in FIG. 3.

For cleaning the steam generator, both openings 11 in outer casing 6 are released by removing the cover mounted thereon, naturally after stopping the steam generator and emptying the uppermost space 4.

On each one of both openings 11 is mounted a spraying device of that type which comprises mainly a frame 15, a high-pressure lance 16 which is slidable along its lengthwise axis and rotatable to-and-fro about said axis relative to said frame and which bears on the front end thereof a spray head 17, and two suction lines 20–23 supported by said frame.

A spraying device which is particularly suitable for the application of the method is disclosed in Belgian Pat. No. 897,603 in the name of the Applicant. Said spraying device comprises means to automatically shift and revolve the high-pressure lance 16. It is clear that the shifting and revolving of the high-pressure lance does not necessarily have to occur with the means as disclosed in Belgian Pat. No. 897,603, included herewith by way of reference, but may also be performed in other ways and even by hand.

Figure 2:
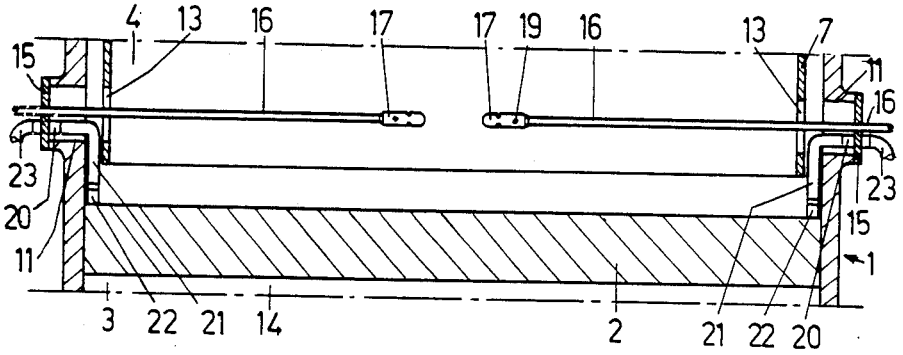
FIG. 2 shows a vertical section of the lowermost part of the steam generator from FIG. 1, during the application of the method according to the invention, but wherein for clearness' sake, the pipe bundle has not been shown.
Figure 3:
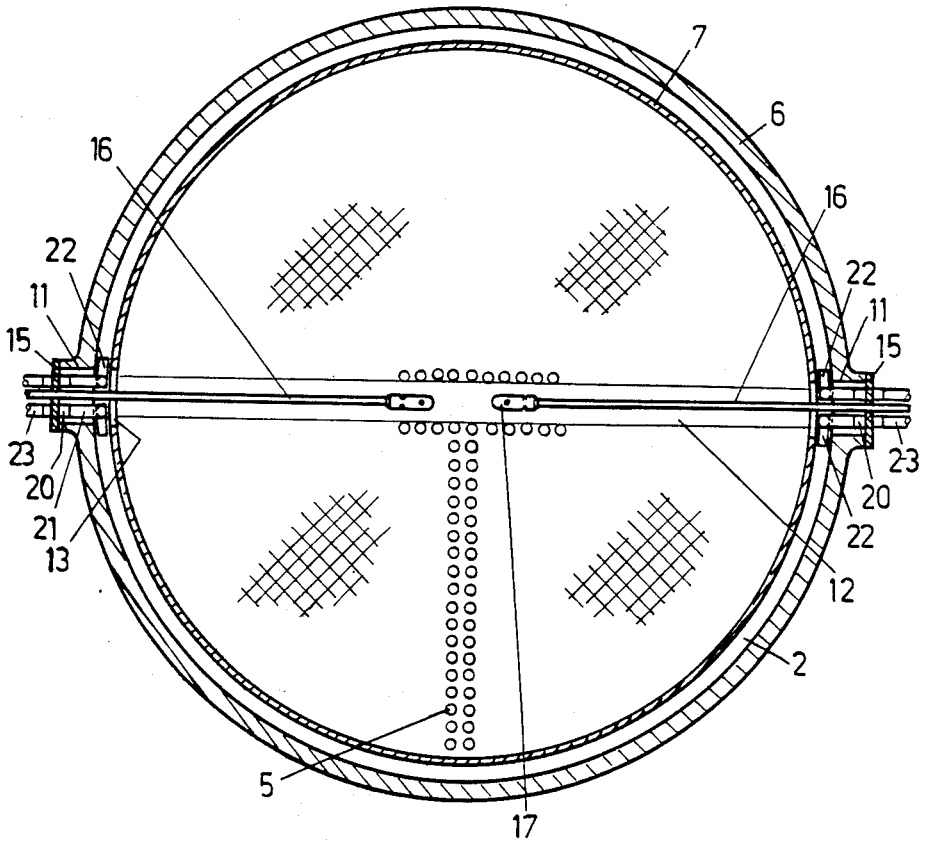
FIG. 3 shows a horizontal section of the lowermost part of the steam generator from FIG. 2, during the application of the method.

The frame 15, which is shown in the simplest form thereof in FIGS. 2 and 3, namely as a mounting flange, is fixed instead of the cover which did close the opening 11, on the outer side of outer casing 6. Said mounting flange closes thereby sealingly the opening 11 about the high-pressure lance 16 and both suction lines 20–23.

For each spraying device, use is made of a high-pressure lance 16 with an outer diameter of 21 mm and an inner diameter of 12.5 mm. The high-pressure lance 16 is naturally so arranged as to have the spray head 17 lie inside vessel 1. That end lying outside said vessel 1 of both high-pressure lances 16 is connected by means of supply hoses to the same high-pressure pump which can pump water under a pressure higher than 200 bars, preferably about 250 bars or more, and with a flow rate of more than 200 liters per minute and preferably of more than 250 liters per minute, for example between 250 and 360 liters per minute. For clearness' sake, neither the supply hoses nor the pump are shown in the figures.

Figure 4:
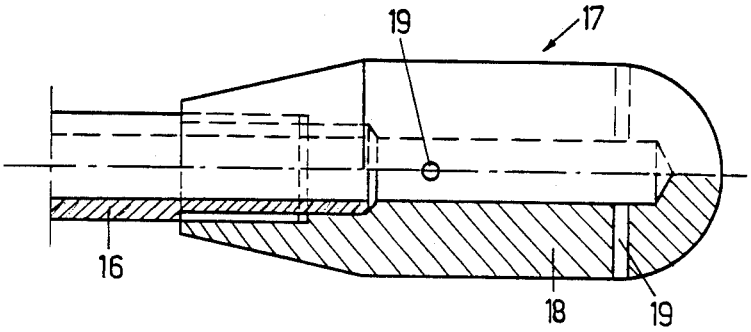
FIG. 4 is a side view in the uppermost half, and shows in the lowermost half, a lengthwise section of a spray head used for the application of the method according to the invention, drawn on a larger scale.

The spray head 17 which is fixedly secured to each one of the high-pressure lances 16, is shown in detail in FIG. 4. Said spray head 17 comprises a hollow round body 18 which is screwed with a cone-shaped end on the corresponding high-pressure lances 16. The inner side of the hollow body 18 opens on the outer side by means of two pairs of round openings 19, directed radially relative to the lance axis and with a diameter of 2 mm. Both openings 19 of the same pair are directed diametrically opposite one another. The openings 19 from one pair are directed at right angle to the openings of the other pair. The spacing between both pairs is equal to the center-to-center spacing between the adjacent rows of the pipe bundle 5, as measured in parallel relationship with the lance axis.

Both spray heads 17 are so brought in the space 12 between the ascending and the descending part of the pipe bundle 5 that said openings 19 lie in the center between two adjacent rows of pipes of the bundle 5. The high-pressure lances 16 pass through an opening 11 in the outer casing 6 and the opposite opening 13 in the inner casing 7, and they are directed with the lengthwise direction thereof radially, in parallel relationship with the bottom 2.

While there is sprayed under the above-defined pressure and with a total flow rate, this is the flow rate for both spray heads 17 together, equal to the above defined flow rate, that is thus with a pressure higher than 200 bars and preferably about 250 bars or more and with a flow rate larger than 200 liters per minute and preferably larger than 250 l/min e.g. between 250 and 360 l/min, both high-pressure lances 16 are moved simultaneously stepwise along the lengthwise direction thereof, that is the radial direction of vessel 1, in parallel relationship with bottom 2. At each step the spray heads 17 are moved over a distance which is equal to the center-to-center spacing between the adjacent pipe rows, as considered in parallel relationship with space 12, or as many times this center-to-center spacing as the spray head 17 is provided with pairs of spray openings 19, that is in the present case thus twice said center-to-center spacing. The spray heads are thereby moved once or a plurality of times between substantially the center of vessel 1 and the outer side thereof, that is approximately next to the outer casing 6 and actually up to against the inner casing 7. The first stepwise shifting while spraying may occur as well towards the center or away from the center.

Between the succeeding small movements of the spray heads 17, that is thus in those moments whereby the spray heads lie with the spray openings 19 thereof between adjacent rows of pipe bundle 5, said spray heads 17 are revolved once and preferably a plurality of times around the lance axis, to-and-fro over an angle which is smaller than 360° and preferably over a total angle of about 180°. In the last case each spray head 17 is swung from its neutral position which it takes during the linear shifting thereof, first over 90° in the one direction, then over 180° in the opposite direction, and finally again towards its neutral position, after which this cycle may possibly be repeated anew.

During the spraying, that is thus during the alternating shifting and revolving of the high-pressure lances 16 with the spray heads 17, the cleaning water which falls on bottom 2, is continuously sucked off. Thereby use of made of one or a plurality of suction pumps for example diaphragm pumps, with a total suction capacity which is markedly larger than the supply capacity for water through the spray heads 17, and thus markedly larger than the above-defined water flow rate. This is required to avoid water remaining on bottom 2. A water layer on bottom 2 would break the streams directed to said bottom 2 from the spray heads 17 and prevent the spraying loose of sludge from bottom 2. Preferably, the total suction capacity of the suction pump or pumps is larger than 1000 liters per minute and for example 1200 liters per minute.

Both suction lines 20–23 of each spray device are naturally connected to the suction pump or pumps, not shown for clearness' sake in the figures. Each suction line 20–23 is comprised of a small tube 20 which is mounted in a seal in said mounting flange of frame 15, a hose 21 connecting thereto on the inner side of vessel 1, a stainless steel shoe 22 connecting to hose 21, and a suction hose 23 which connects the small tube 20 to the suction pump or pumps.

Figure 5:
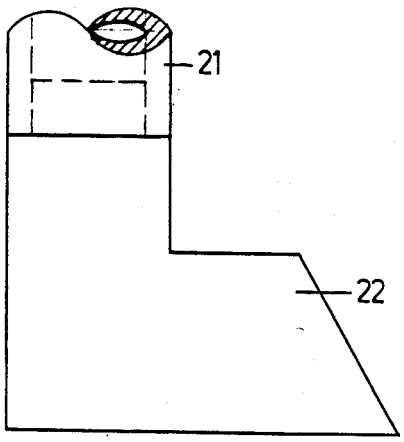
FIG. 5 is a side view of a detail of the suction line used for the application of the method according to the invention, also on a larger scale than FIGS. 1 to 3.

The shoe 22 is shown in detail in FIG. 5. The flexible hose 21 connects to the uppermost open end of the shoe. The shoe foot is also open at the top. The shoe 22 fits between the outer casing 6 and the inner casing 7. When arranging each spray device, both shoes 22 of both suction lines 20–23 of this device are let down between outer casing 6 and inner casing 7, until the foot bears on bottom 2, so that both shoes 22 are directed with the open top thereof away from one another along the circumference of bottom 2.

The water which is sucked off by means of the suction pump or pumps, is fed to a filter unit which may be of known structure and will not be shown in the figures for clearness' sake. Said filter unit comprises three filter housings which are succeedingly provided with filter cartridges with a fineness of respectively 10, 5 and 0.5 microns. The filtered water is fed to a supply tank from which it is anew sucked, notably for feeding the high-pressure lances 16.

The above-described operations, namely the alternating shifting and revolving while spraying of the high-pressure lances 16 with spray heads 17, and the simultaneous sucking and filtering of the cleaning water, are conducted until no sludge can be seen any more in the sucked water through the sight glasses which are mounted in the hoses 23. The feed and discharge pumps are stopped and the spraying devices are removed. Finally the openings 11 are closed back by a cover.

In another embodiment of a steam generator, the lowermost supporting plate 8 lies somewhat nearer the bottom 2 and actually level with both said openings 11 lying opposite one another in the outer casing 6, which openings 11 lie in turn higher. Such other embodiment of the steam generator further differs from the above-described embodiment in the inner casing 7 ending at a longer distance from bottom 2 and, underneath said inner casing 7, four smaller openings 24 are arranged in outer casing 6.

Said openings have a diameter of but 50 mm. The four openings are staggered by approximately 90° relative to one another, but they are not located on the symmetry planes of the pipe bundle. No single opening 24 thus opens on space 12, but all of the openings 24 open directly on the pipe bundle 5. The openings 24 are directed with the lengthwise direction thereof approximately in the radial direction.

Figure 6:
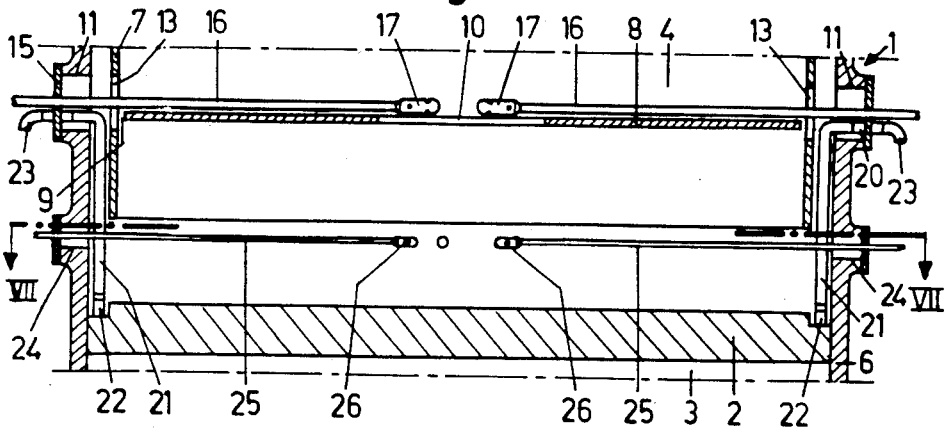
FIG. 6 shows a vertical section similar to the one in FIG. 2, of part of a steam generator during the application of the method according to the invention, but pertaining to another embodiment of said steam generator and also another embodiment of the method according to the invention.
Figure 7:
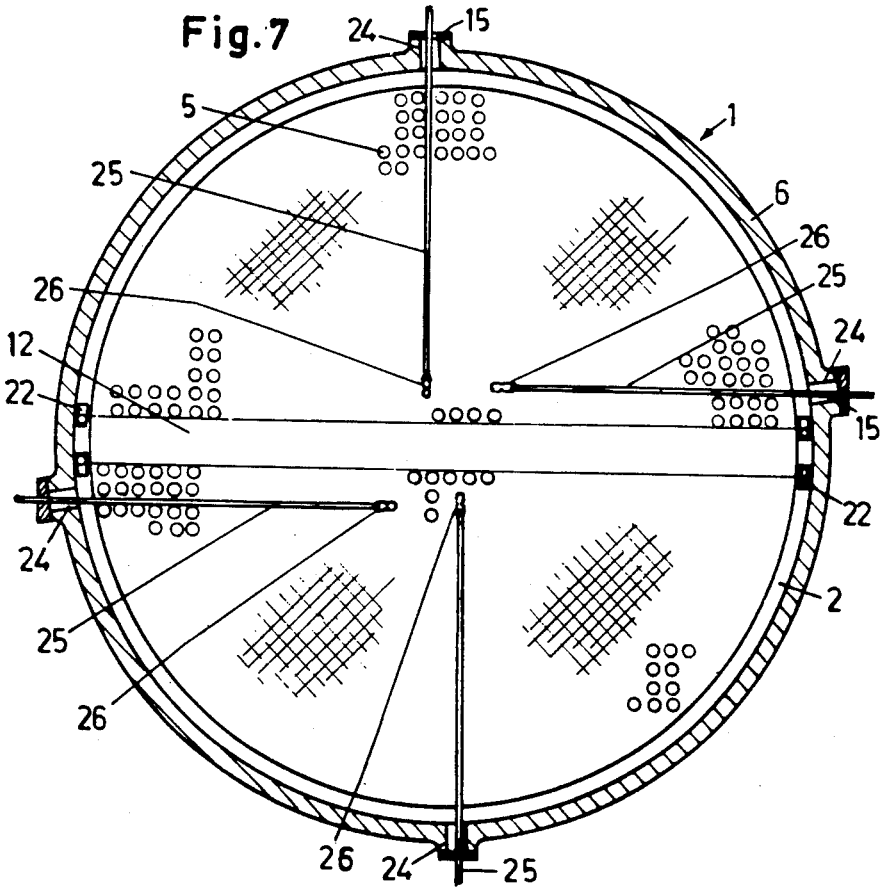
FIG. 7 shows a horizontal section of that part shown in FIG. 6 of the steam generator, made along that plane shown in FIG. 6 by line VII—VII.

FIGS. 6 and 7 pertain to such a steam generator.

The cleaning of such a steam generator is performed in two steps.

During a first step, the upper side of the lowermost supporting plate 8 together with the steam generator part lying directly above, is cleaned, at least partly.

One proceeds thereby exactly in the same way as when cleaning bottom 2 in the above-described embodiment of the method. Over each opening 11 is thus mounted as described above, a spraying device with a high-pressure lance 16 and a spray head 17 mounted thereon. Said high-pressure lance 16 extends through the opening 13 in inner casing 7 and above the lowermost supporting plate 8. While spraying with the above-defined pressure and flow rate, both spray heads 17 are simultaneously shifted stepwise, while between two succeeding steps, said spray heads are revolved one or a plurality of times to-and-fro preferably over an angle of about 180°. After having determined visually by means of sight glasses which are mounted in the suction hoses 23, that substantially no sludge is carried along with the sucked water, the spraying is stopped, but both spraying devices are left on the steam generator.

The second step is now performed, whereby the bottom 2 and that portion of the steam generator lying between bottom 2 and the lowermost supporting plate 8 are cleaned, while further cleaning that portion of the steam generator lying above the supporting plate 8.

The covers which close the four openings 24 are first removed. Instead of each cover, there is mounted a spraying device which is similar to the above-described spraying device but which differs structurally mainly due to said devices comprising no suction hoses, the high-pressure lances 25 having but an outer diameter of 8 mm and an inner diameter of 3 mm, the spray head 26 mounted on each such high-pressure lance 25 also having a smaller diameter than said spray heads 17 and moreover being provided with but one pair spraying openings 19 lying opposite one another which openings have moreover but a diameter of 1.8 mm.

The smaller size of the high-pressure lances 25 with the pertaining spray heads 26 results from the fact that said components are not brought in a space 12 but on the contrary cross-wise through the pipe bundle 5.

The lengthwise direction of the high-pressure lances is so selected as to let said latter ones pass between the pipes, and said lengthwise direction may differ thereby from the lengthwise direction of the openings 24. The mounting flange of the frame 15 of each of said latter spray devices is then also specially fitted to impart after securing against the edges of an opening 24, the required direction to the shiftable and revolvable high-pressure lance 25.

The four high-pressure lances 25 are connected to the same high-pressure pump to which both high-pressure lances 16 are also connected, and water under said pressure higher than 200 bars and preferably higher than 250 bars is sprayed at the same time through the four spray heads 26 and the two spray heads 17. There is sprayed thereby through the six spray heads together a total mean flow rate which is larger than 200 liters per minute and lies preferably between 250 and 360 liters per minute. During the spraying, the water is sucked from the bottom 2 with a suction capacity which is markedly larger than said latter flow rate and which is preferably higher than 1000 liters per minute, and lies for example in the range of 1200 liters per minute, by means of the four suction lines 20–23 which are part of the two devices which are mounted on the openings 11.

During the spraying and sucking, as well the four high-pressure lances 25 with spray heads 26 as the two high-pressure lances 16 with spray heads 17 are moved. simultaneously and stepwise between approximately the center of vessel 1 and the outer side thereof, whereby between each two steps, the high-pressure lances 25 and 16 respectively with the pertaining spray heads 26 and 17 respectively, are swung to-and-fro, preferably over 180° in the above-described way.

The intermittent shifting of said high-pressure lances 16 does not have necessarily to occur synchroneously with the intermittent shifting of the four lower high-pressure lances, but said shiftings are actually preferably performed synchroneously. In said latter case, the high-pressure lances 16 and 25 are moved at each step over a distance which is equal to the center-to-center spacing between the pipes, as the spray heads have but one pair spraying openings 19 and between the succeeding shiftings and thus during the to-and-fro swinging, said spraying openings have to lie opposite the following intermediate spaces between the pipe rows of bundle 5.

Part of the water supply is sprayed through the spray heads 17, but said heads are not means for causing a well-determined directed stream over bottom 2.

Not only do these spray heads spray with the same pressure as the spray heads 26, but during the spraying said spray heads 17 are shifted and revolved alternatively. The spray heads 17 take consequently actually part in the cleaning process. When the spray heads 17 lie above the center opening 10 in the lowermost supporting plate 8, which opening is quite large and has a diameter in the range of 80 cm, said spray heads spray directly on the bottom 2. When the spray heads 17 lie next to the opening 10, they further clean the supporting plate 8 and that portion lying thereabove of the steam generator. The water sprayed through the spray heads 17 can fall as well through the opening 10 as through the slit 9 on bottom 2 and the path selected by the water is dependent on the location of the spray heads 17 and thus is not always the same.

All of the above-described embodiments of the method are quite simple and allow a fast and very good cleaning of the steam generator.

The invention is in no way limited to the above-described embodiments and within the scope of the patent application, many changes may be brought to the described embodiments, notably as regards the shape, the composition, the arrangement and the number of the components which are being used for embodying the invention.

It is particularly not necessary to spray constantly during the cleaning. It may be enough to spray exclusively when the spray heads are being swung to-and-fro. In this case the above mentioned conditions of flow rate have to be met during each spraying. Moreover one might also spray in a pulsated way instead of spraying continuously, in which case, the mean flow rate has to fulfil the above-defined conditions.

The liquid which is sprayed does not necessarily have to be water. Other cleaning liquids may be sprayed.

More than one pump can be used to supply liquid to the spray heads.

I claim:

1. A method for cleaning a steam generator of the so-called U-type which includes an upstanding outer casing; a pipe bundle in the shape of a U mounted in the casing, the pipe bundle having an upward-extending bundle portion and a downward extending bundle portion with a space between the two portions, each bundle portion comprising a number of spaced rows of pipes; a bottom at the foot of the pipe bundle which closes the openings between the pipes and between the pipes and the outer casing; at least two accesses through the outer casing at substantially opposite sides thereof, the accesses lying above the bottom and providing access to the space between the two bundle portions; the method comprising the steps of:

(a) introducing through each of the two accesses and into the space between the pipe bundle portions an elongated, rigid high pressure lance which is rotatable about its longitudinal axis and is shiftable in the direction of its longitudinal axis, each lance including a spray head at the end thereof introduced into said space, the spray head having at least one pair of radially directed spray openings for directing fluid jets radially outwardly from the longitudinal axis of the lance on substantially opposite sides of the spray head;

(b) introducing through each of the two accesses at least one suction line provided with at least one suction opening situated adjacent the bottom within the outer casing;

(c) shifting simultaneously stepwise both lances such that between each shifting step the jets from the spray head are directed between the rows of pipes of the pipe bundle portions;

(d) oscillating both of the lances at least between the shifting steps;

(e) spraying a cleaning liquid through the spray heads at least during the oscillating of the lances under a pressure higher than 200 bars and with a mean flow rate for both spray heads together of more than 200 liters per minute; and (f) sucking the sprayed liquid away from the bottom through the suction lines during the cleaning with a total suction capacity which is markedly higher than the mean flow rate of the spray heads together.

2. The method of claim 1 wherein each of said spray heads includes a second pair of radially directed spray openings for directing fluid jets radially outwardly from the longitudinal axis of the lance on substantially opposite sides of the spray head, the second pair of spray openings being longitudinally spaced from said at least one pair by a distance substantially equal to the center-to-center distance between adjacent rows of pipes in said bundle portions, the directions of fluid jets from said at least one and said second pair of spray openings being substantially perpendicular.

3. The method of claim 1 wherein both of the lances are oscillated over an angle of about 180 degrees.

4. The method of claim 1 wherein the high-pressure lances bearing a spray head at the end thereof are oscillated at least once to-and-from from a neutral position succeedingly over the 90 degree in the one direction and back, and over about 90 degrees in the other direction and back.

5. The method of claim 1 wherein liquid is sprayed through the spray heads with a pressure of at least about 250 bars.

6. The method of claim 1 wherein a total mean flow rate which lies between 250 and 360 liters per minute is sprayed.

7. The method of claim 1 wherein a suction capacity of at least 1000 liters per minute is used to suck the sprayed liquid from the bottom.

8. The method of claim 1 wherein a line which comprises a flexible suction hose and a metal shoe as an end portion is used for sucking the sprayed liquid from the bottom.

9. The method of claim 1 wherein two suction lines are arranged in each one of said two openings lying opposite one another and through which a high-pressure lance is introduced, the suction openings of both lines being directed along the circumference of the outer casing but in opposite directions.

10. The method of claim 1 wherein there is cleaned a steam generator which comprises moreover an inner casing which is mounted inside the outer casing and around the pipe bundle and reaches down to some distance away from the bottom, and a supporting plate for the pipe bundle which is mounted above the bottom in the inner casing with at least a major portion of the outer circumference thereof loose from the inner casing, so that liquid can fall over the edge thereof on the bottom, which steam generator is provided, in the outer casing thereof, between the bottom and said supporting plate, with at least two openings lying approximately opposite one another, and is provided in the inner casing thereof, opposite each opening in the outer casing, also with an opening in which method said two high-pressure lances are each introduced through an opening in the outer casing and an opening in the inner casing.

11. A method for cleaning a steam generator of the so-called U-type which includes an upstanding outer casing; a pipe bundle in the shape of a U mounted in the casing, the pipe bundle having an upward-extending bundle portion and a downward extending bundle portion with a space between the two portions, each bundle portion comprising a number of spaced rows of pipes; a bottom at the foot of the pipe bundle which closes the openings between the pipes and between the pipes and the outer casing; at least two accesses through the outer casing at substantially opposite sides thereof, the accesses lying above the bottom and providing access to the space between the two bundle portions; the method comprising the steps of:

(a) introducing through each of the two accesses and into the space between the pipe bundle portions an elongated, rigid high pressure lance which is rotatable about its longitudinal axis and is shiftable in the direction of its longitudinal axis, each lance including a spray head at the end thereof introduced into said space, the spray head having two pairs of radially directed, longitudinally spaced spray openings, each pair being disposed to direct fluid jets radially outwardly from the longitudinal axis of the lance on substantially opposite sides of the spray head, the pairs being longitudinally spaced by a distance substantially equal to the center-to-center spacing between adjacent rows of pipes of the pipe bundle portions and the fluid jets directed outwardly therefrom being approximately perpendicular to each other;

(b) introducing through each of the two accesses at least one suction line provided with at least one suction opening situated adjacent the bottom within the outer casing;

(c) shifting simultaneously stepwise both lances such that between each shifting step the jets from the spray head are directed between the rows of pipes of the pipe bundle portions;

(d) oscillating both of the lances through an angle of about 90 degrees on each side of a neutral position at least between the shifting steps;

(e) spraying a cleaning liquid through the spray heads at least during the oscillating of the lances under a pressure higher than 200 bars and with a mean flow rate for both spray heads together of more than 200 liters per minute, whereby the jets from the two pairs of openings in the spray heads of each lance move across the entire area of the bottom between two adjacent rows of pipes of the pipe bundle portions; and (f) sucking the sprayed liquid away from the bottom through the suction lines during the cleaning with a total suction capacity which is markedly higher then the mean flow rate of the spray heads together.

12. The method of claim 11 wherein the lances are introduced through the accesses such that the spray heads are positioned adjacent the center of the generator and the lances are stepwise shifted simultaneously toward the outer casing.

13. A method for cleaning a steam generator of so-called U type, which steam generator consequently comprises:

an upstanding outer casing;

a pipe bundle mounted therein, which extends in the shape of a reversed U and comprises an upwards-extending bundle portion and a downwards-extending bundle portion with a space between both portions, each portion comprising a number of rows spaced from each other and extending crosswise to said space;

a bottom which closes at the foot of the pipe bundle the openings between the bundle pipes and between said pipes and the outer casing;

an inner casing which is mounted inside the outer casing and around the pipe bundle and reaches down to a distance from the bottom; and a supporting plate for the pipe bundle, which supporting plate is mounted above the bottom inside of the inner casing, with at least a major portion of the circumference thereof loose from the inner casing, so that liquid can fall over the edge thereof on the bottom, which supporting plate is provided in the center thereof with an opening, which steam generator is provided between the bottom and supporting plate with a plurality of accesses giving access to the pipe bundle, and is provided directly above the supporting plate with two accesses lying opposite one another and giving access to the space between said two bundle portions inside the inner casing, which method comprises:

cleaning the space above the supporting plate by;

(a) introducing through each of said two accesses above the supporting plate an elongated high pressure lance which is rotatable about its longitudinal axis, is shiftable in the direction of its longitudinal axis and carries, fixedly mounted on the end introduced through the access, a spray head provided with at least one pair of radially directed spray openings;

(b) introducing through each of said two accesses above the supporting plate at least one suction line comprising an end portion provided with at least one suction opening, said end portion being situated against the bottom and against the outer casing;

(c) shifting simultaneously stepwise both lances, in such a way that between each shifting step the spray heads spray between rows of the pipe bundle;

(d) oscillating said lances over an angle of about 180 degrees at least between shifting steps;

(e) spraying cleaning liquid through said spray heads, at least during said oscillating, under a pressure higher than 200 bars and with a flow rate for both spray heads together of more than 200 liters per minute; and (f) sucking the used cleaning liquid away from the bottom through the suction line during the cleaning with a total sucking capacity which is markedly higher than said latter flow rate; and cleaning the space between the bottom and the supporting plate by:

(a) introducing through each of said plurality of accesses to the space between the bottom and the supporting plate a rigid high pressure lance which is rotatable about its longitudinal axis, is shiftable in the direction of said longitudinal axis and carries fixedly mounted on its end a spray head provided with at least one pair of radially directed spray openings;

(b) shifting stepwise said lances in such a way that between each shifting step the spray heads may spray between rows of the pipe bundle;

(c) oscillating said lances over an angle of about 180 degrees at least between shifting steps;

(d) spraying cleaning liquid through said spray heads, at least during said oscillating under a pressure higher than 200 bars; and (e) sucking the used cleaning liquid away from the bottom through said suction line introduced for cleaning the space above the supporting plate with a total sucking capacity which is markedly higher than the total flow rate of liquid sprayed.

14. The method of claim 13 which further comprises during the cleaning of the space between the bottom and supporting plate;

shifting simultaneously stepwise both lances introduced above the supporting plate;

oscillating said both lances over an angle of about 180 degrees at least between shifting steps; and spraying cleaning liquid through said two spray heads, at least during said oscillating, under a pressure higher than 200 bars and with a mean flow rate for both spray heads together, that together with the total flow rate of the four spray heads together in the space between the bottom and the supporting plate, is more than 200 liters per minute.

15. The method of claim 13 wherein each of the spray heads introduced above the supporting plate includes two pairs of radially directed spray openings, the openings of one pair being directed at right angle to the openings of the other pair, and both pairs lying at a distance from one another which corresponds to the center-to-center spacing, between the rows of the pipe bundle as measured in the direction of the longitudinal axis of the lance.

16. The method of claim 13 wherein four accesses are provided between the bottom and the supporting plate and wherein a rigid high pressure lance is introduced through each of said four accesses.

17. A method for cleaning a steam generator of so-called U type, which steam generator consequently comprises:

an upstanding outer casing;

a pipe bundle mounted therein, which extends in the shape of a reversed U and comprises an upwards-extending bundle portion and a downwards-extending bundle portion with a space between both portions, each portion comprising a number of rows spaced from each other and extending crosswise to said space;

a bottom which closes at the foot of the pipe bundle the openings between the bundle pipes and between said pipes and the outer casing;

an inner casing which is mounted inside the outer casing and around the pipe bundle and reaches down to a distance from the bottom; and a supporting plate for the pipe bundle, which supporting plate is mounted above the bottom inside the inner casing, with at least a major portion of the circumference thereof loose from the inner casing, so that liquid can fall over the edge thereof on the bottom, which supporting plate is provided in the center thereof with an opening, which steam generator is provided between the bottom and supporting plate with four accesses giving access to the pipe bundle, and is provided directly above the supporting plate with two accesses lying opposite one another and giving access to the space between said two bundle portions inside the inner casing, which method comprises:

cleaning the space above the supporting plate by:

(a) introducing through each of said two accesses above the supporting plate a right high pressure lance which is oscillating around its longitudinal axis, is shiftable in the direction of its longitudinal axis and carries fixedly mounted on its end a spray head provided with two pairs of radially directed spray openings, the openings of one pair being directed at right angle to the openings of the other pair, and both pairs lying at a distance from one another which corresponds to the centr-to-center spacing, between the rows of the pipe bundle as measured in the direction of the longitudinal axis of the lance;

(b) introducing through each of said two accesses above the supporting plate at least one suction line comprising an end portion provided with at least one suction opening, said end portion being situated against the bottom and against the outer casing and being directed with the suction opening along the circumference of the bottom;

(c) shifting simultaneously stepwise both lances, in such a way that between each shifting step the spray heads may spray between rows of the pipe bundle;

(d) oscillating said lances over an angle of about 180 degrees at least between two succeeding shifting steps;

(e) spraying cleaning liquid through said spray heads, at least during said oscillating, under a pressure higher than 200 bars and with a flow rate for both spray heads together of more than 200 liters per minute; and (f) sucking the used cleaning liquid away from the bottom through the suction line during the cleaning with a total sucking capacity which is markedly higher than said latter flow rate; and cleaning the space between the bottom and the supporting plate by:

(a) introducing through each of said four accesses to the space between the bottom and the supporting plate a rigid high pressure lance which is oscillating around its longitudinal axis, is shiftable in the direction of said longitudinal axis and carries fixedly mounted on its end a spray head provided with at least one pair of radially directed spray openings;

(b) shifting stepwise said lances in such a way that between each shifting step the spray heads may spray between rows of the pipe bundle;

(c) oscillating said lances over an angle of about 180 degrees at least between shifting steps;

(d) spraying cleaning liquid through said spray heads, at least during said oscillating under a pressure higher than 200 bars; and (e) sucking the used cleaning liquid away from the bottom through said suction line introduced for cleaning the space above the supporting plate with a total sucking capacity which is markedly higher than the total flow rate of liquid sprayed.

* * * * *